United States Patent [19]

Bollen et al.

[11] 4,329,670

[45] May 11, 1982

[54] MERCURY REED SWITCH

[75] Inventors: Romain L. F. Bollen, Hasselt; Jean-Marie M. G. Ponsard, Alken, both of Belgium

[73] Assignee: C. P. Clare International N.V., Belgium

[21] Appl. No.: 129,743

[22] Filed: Mar. 12, 1980

[51] Int. Cl.[3] ..... H01H 29/00

[52] U.S. Cl. ..... 335/56; 335/58

[58] Field of Search ..... 335/55, 56, 57, 58, 335/203

[56] References Cited

U.S. PATENT DOCUMENTS

| | | | |
|---|---|---|---|
| 2,303,474 | 12/1942 | Kalb | 335/56 |
| 2,921,161 | 1/1960 | Scata et al. | 335/203 |
| 3,380,006 | 4/1968 | Donath | 335/56 |
| 4,199,739 | 4/1980 | Deith | 335/58 |

*Primary Examiner*—Harold Broome

*Attorney, Agent, or Firm*—Stevens, Davis, Miller & Mosher

[57] ABSTRACT

A reed switch comprising a sealed capsule which includes a movable armature consisting in a beam of magnetic material having two pole ends capable of alternate contacting engagement with a respective of two distinct stationary contacts when the armature is pivoting in a longitudinal axial plane. The armature is suspended symmetrically to the ends of a helicoidal spring which extends axially around the armature beam and which is fixedly positioned inside the capsule by means of a cylindrical annular electrode. The coacting surfaces of the pole ends and the stationary contacts are provided with spots made of a material which cannot be wetted by the mercury also included in the capsule. Magnetic means in various embodiments are also provided to create the initial magnetic condition according to the mode of switching operation desired.

8 Claims, 9 Drawing Figures

MERCURY REED SWITCH

BACKGROUND OF THE INVENTION

The present invention relates to an improved mercury reed switch operating in the so-called Form C mode, that is a switch having a break-before-make combination or single-pole, double-throw combination.

A mercury reed switch comprises a reed armature having its base immersed in a pool of mercury and having its upper end movable between two stationary contacts. The capillary action allows the mercury to flow over the reed surface, thereby wetting the contacting surfaces of the armature and the contacts, giving actually a mercury-to-mercury contact which has a very low contact resistance.

The prior art for a break-before-make mercury switch is illustrated in FIG. 1. Within a sealed capsule, the armature is formed of a cantilever beam 1 fixed at its lower end which is immersed in the mercury pool 2. The armature is adjusted in a neutral position between the contacts 3 and 4 so that the armature acts as a spring without initial pressure. The normally closed condition is obtained by using a permanent magnet externally fixed to the capsule. By adjusting the position of the magnet, the arrangement as described can operate in a normal monostable switching mode (with free return of the armature to the normally closed condition after deenergization. or a latching mode (bistable action with return of the armature to the normally closed condition only in response to an inverse energization). In FIG. 1, the magnet P is positioned for creating a bistable mode of operation. In either case, the function of the cantilever beam is to provide enough mechanical retractile force around a fixed oscillation point. A drawback of such an arrangement is that the switch must be used in a vertical position and this restricts its use to those cases where this condition is met. Furthermore such a capsule can hardly be miniaturized and it is relatively expensive.

SUMMARY OF THE INVENTION

The object of the invention is to provide a miniature mercury reed switch which is capable of operating in any position.

In accordance with the invention a sealed capsule includes a movable armature comprising a beam of magnetic material having a pair of pole ends capable of alternate contacting engagement with a respective stationary contact when said armature oscillates. The armature is symmetrically suspended to the ends of a helicoidal spring which extends axially around the armature beam and which is fixedly positioned inside the capsule by means of a cylindrical annular electrode attached to the central portion of said spring. A film of mercury wets the surface of the armature, the helicoidal spring, the inner wall of the annular electrode and the surface of the contacts.

A miniature all-position mercury switch as provided according to this invention can advantageously be used in any application where high life, high reliability and/or an all-position capability are a need, e.g.: test equipment, military equipment, telecommunications and more particularly subscriber equipment, process control equipment.

DESCRIPTION OF EXEMPLARY EMBODIMENTS

Figure 1:
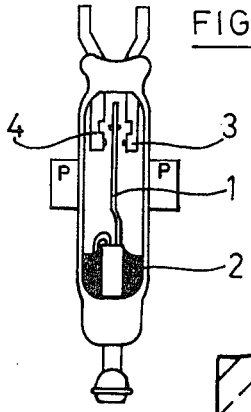
FIG. 1 PRIOR ART
FIG. 1 shows, for comparison purpose, an embodiment illustrating the prior art.
Figure 2:
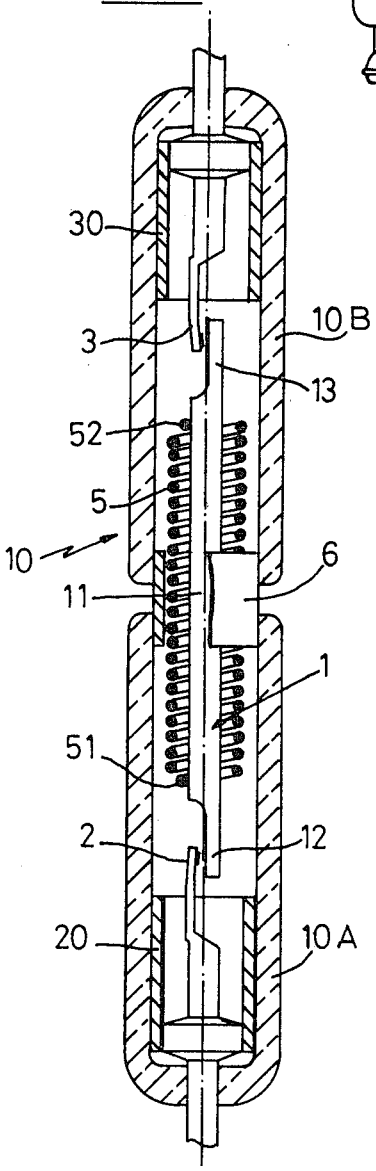
FIG. 2 is a lengthwise section of the capsule of a reed switch according to the invention.

Referring to FIG. 2 it is shown that the armature 1 has a central beam portion 11 with two pole ends 12 and 13. The contacts 2 and 3 are situated at opposite end sides of the armature 1 so as to enable either of the pole ends 12, 13 of the armature to be in contact engagement with a respective of said contacts when the armature 1 is oscillating. The armature is made of a magnetic material, e.g. Permalloy or Crovar (a product of the firm Vacuumschmelze GmbH, Hanau, West Germany). Extending lengthwise around the beam portion 11 of the armature is a helicoidal spring 5 attached to a fixed cylindrical body 6 serving as an annular electrode. The spring 5 is centrally positioned so as to extend symmetrically relative to the mid-point of the armature 1 and it is fixedly positioned inside the sealed capsule 10. The spring 5 is designed to work in a flexure mode. The armature beam 11 is symmetrically suspended to the ends 51 and 52 of the spring 5. The pole ends 12 and 13 of the armature project beyond the spring 5.

The capsule 10 is provided with external way-outs for the contacts 2 and 3 and the annular electrode 6. In the illustrative embodiment, the capsule 10 is formed of two glass tubes 10A, 10B aligned in spaced apart relation and sealed to the annular electrode 6 symmetrically relative to the pivot point of the armature 1. The contacts 2 and 3 are surrounded within the capsule by metallic tubes 20, 30 serving as magnetic shunts. The inner wall of the tubes 20 and 30, the surface of the armature 1, the spring 5, the inner surface of the annular electrode 6 and the surface of the contacts 2 and 3 are wetted with a film of mercury.

Figure 3:
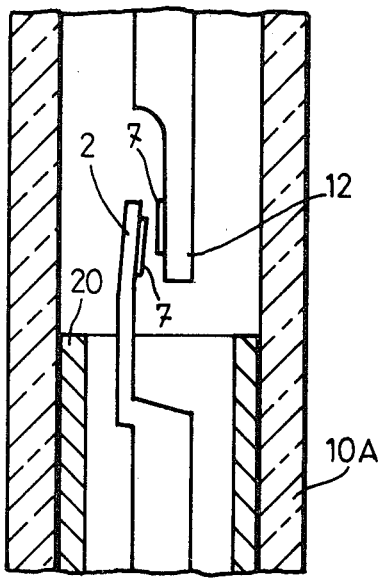
FIG. 3 is an enlarged view of a portion of FIG. 2.

The coacting surfaces of the pole ends 12, 13 of the armature and the contacts 2 and 3 are provided with spots 7 (FIG. 3) made of a material which cannot be wetted with mercury, e.g. chromoxide. These spots must have an area which is sufficiently small such that, when the armature 1 is being switched, splashing mercury from the contact zones is quickly enough replaced otherwise the working of the switch at a high switching frequency would be made difficult. The pole ends 12 and 13 of the armature are made sufficiently wide such that a too great mercury drop which would be projected onto the wall of the tubes can be sucked up by said poles.

To be operative, the mercury switch as described above has to be completed by an energizing coil as known in the art of reed switches. The operation of the mercury switch of the invention is illustrated in FIGS.

Figure 4:
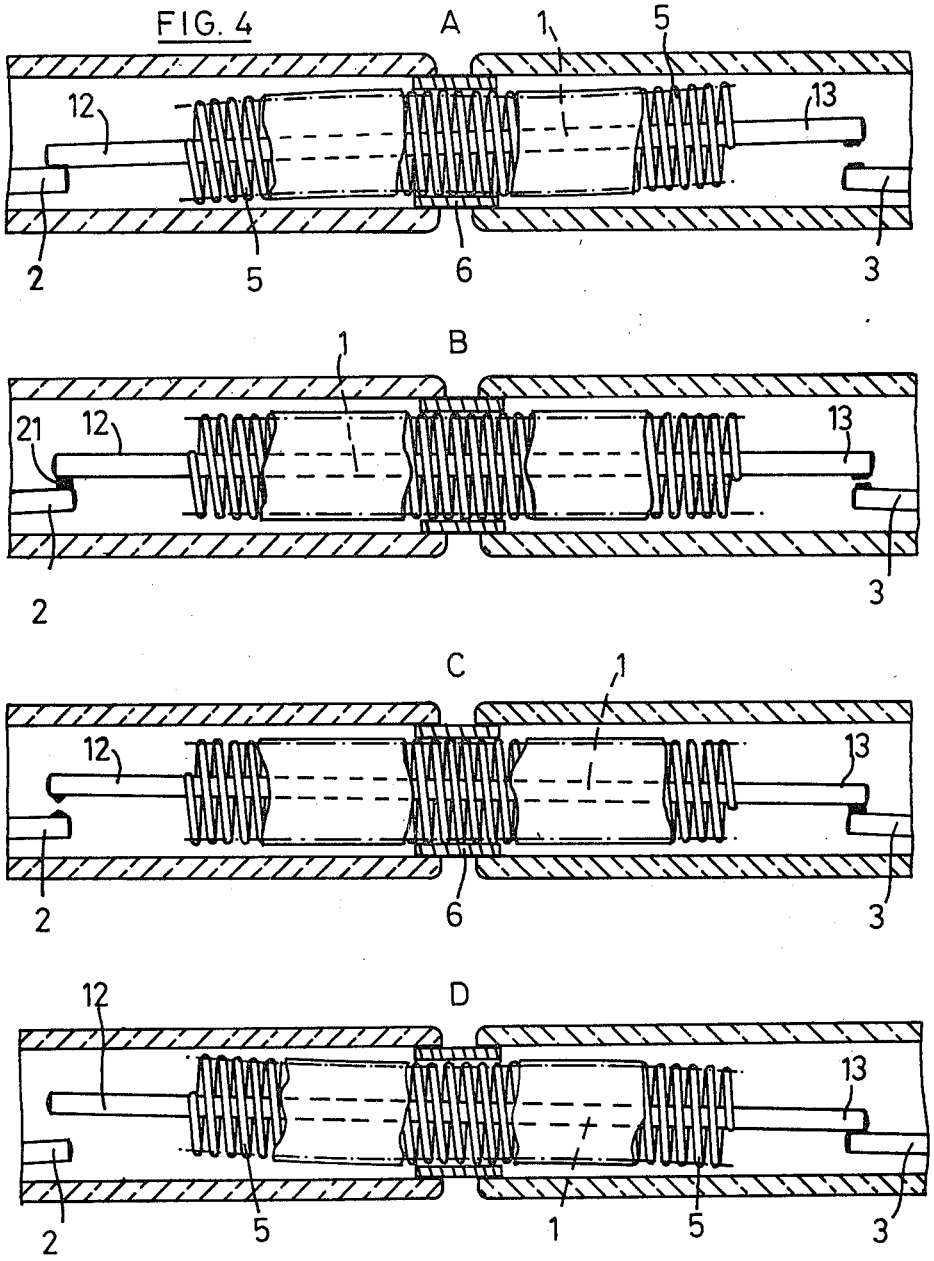
FIG. 4 illustrates the operation of the reed switch according to the invention.

4 A/D where the energizing coil is not represented. An initial magnetic condition is created by one of the means to be described hereinafter. FIG. 4A shows the contact 2 being closed and contact 3 being open. Without the energizing coil being energized, the left and right end portions of the spring are subjected to some flexion moment due to the initial desequilibrium. The end portions of the spring 5 store some mechanical energy.

When the coil is being energized, the magnetic field thus generated creates a magnetic force which tends to pivot the armature 1 (FIG. 4B). The pole 12 of the armature 1 then moves away from contact 2, thus creating a mercury bridge 21 there. This mercury bridge breaks before the pole end 13 of the armature reaches the contact 3 (FIG. 4C). Finally, the moving armature 1 closes its pole end 13 to contact 3 (FIG. 4D). The end portions of the spring 5 again store some mechanical energy. It is apparent that the armature 1 oscillates about a fictive pivot point.

Figure 5:
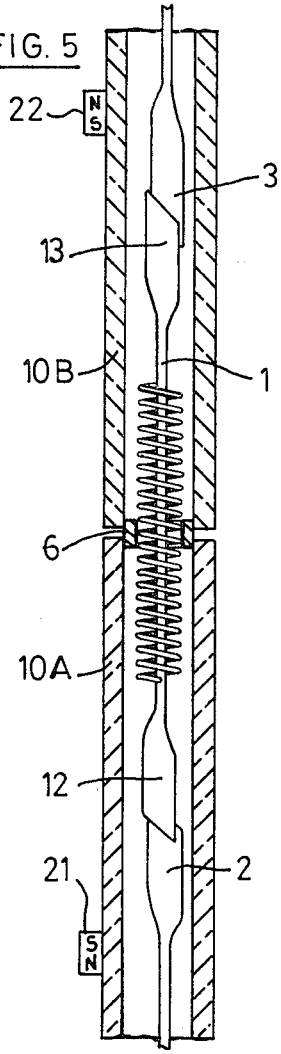
FIGS. 5 and 6 show two exemplary embodiments of the reed switch according to the invention.
Figure 6:
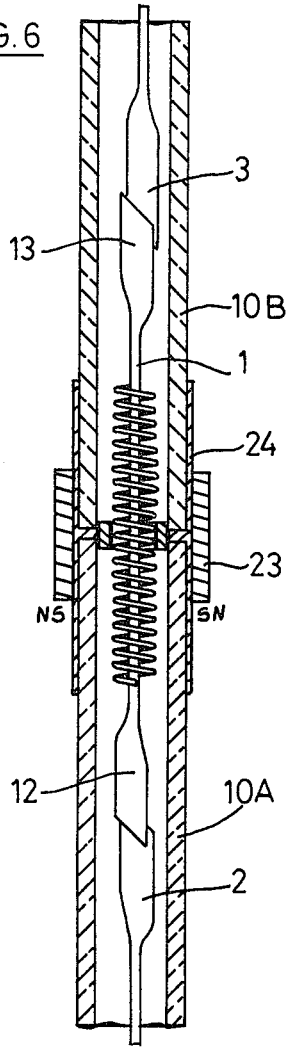

The initial magnetic condition is created by magnetic means which are described hereafter with reference to FIGS. 5 to 8 of the drawings. In FIGS. 5 and 6 there are shown two examples of embodiments using external permanent magnets for creating the initial magnetic condition. In the embodiment of FIG. 5 use is made of two permanent magnets 21, 22 fixed externally to the capsule 10. The strength and position of the magnets along the capsule are chosen according to whether a monostable or a bistable mode of operation is desired. For a monostable mode of operation which requires a magnetic unbalance in the system, use will be made of two magnets having unequal strengthes symmetrically positioned with regard to the pivot point of the armature 1 or of two equal magnets positioned at unequal distances from said pivot point. An annular permanent magnet can equally be positioned off the transverse axis of the capsule.

For a bistable mode of operation which requires a magnetic balance in the system, two magnets will be positioned so as to create two equal magnetic forces. The same result will be obtained by using a sole annular permanent magnet centrally positioned on the transverse axis of the capsule. FIG. 6 illutrates an embodiment with an annular permanent magnet denoted 23. The external connection to the annular electrode 6 is achieved through a sheet of electroconducting material 24 placed around the glass tubes 10A and 10B.

Figure 7:
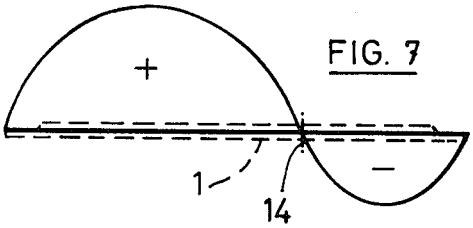
FIGS. 7 and 8 diagrammatically show two polarization profiles of the armature in a third embodiment of the reed switch according to the invention.
Figure 8:
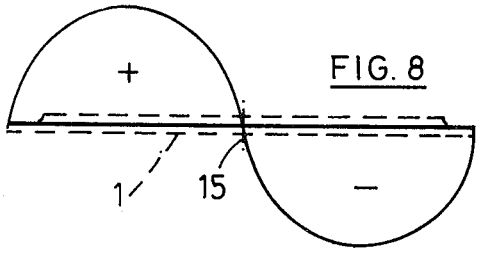

The initial magnetic condition can also be created without using external permanent magnets. For that purpose the armature 1 is made polarized so as to constitute a permanent magnet by itself. The FIGS. 7 and 8 show diagrammatically the polarization profiles to be achieved for the switch to operate in a monostable and a bistable mode of operation. For a monostable mode (FIG. 7) the armature 1 is polarized oppositely on both sides of a section 14 off the median section of the armature. For a bistable mode (FIG. 8) the armature 1 is polarized oppositely on both sides of the median section 15. The annular electrode 6 is usually connected to ground.

Figure 9:
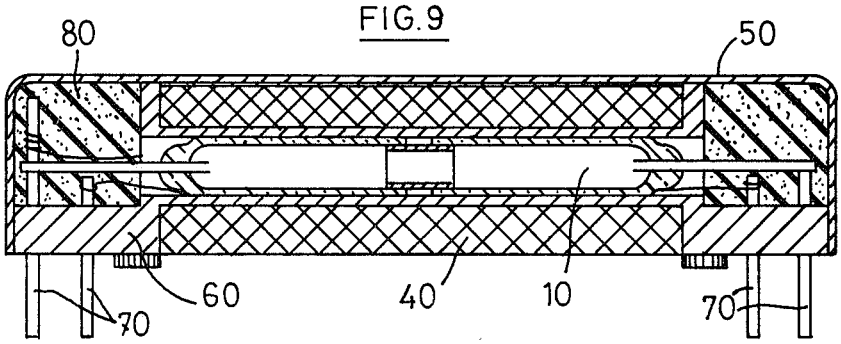
FIG. 9 is a sectional view of an exemplary embodiment of a miniature component incorporating a mercury reed capsule according to the invention.

The small size in which the mercury capsule according to the invention can be manufactured permits to produce a miniature integrated switch component including one or several mercury capsules as described in the foregoing together with the necessary energizing coil(s). FIG. 9 depicts an exemplary embodiment of such an integrated component including one mercury capsule 10 and the energizing coil associated therewith housed inside a housing comprising a cover 50 mounted on a base-plate 60. The connection terminals are denoted 70. The reference numeral 80 denotes a filling compound.

What is claimed is:

1. A mercury reed switch comprising:

a capsule;

a pair of stationary contacts included inside said capsule;

a helicoidal spring extending axially inside said capsule;

a cylindrical annular electrode extending around and being attached to the central portion of said helicoidal spring, said annular electrode being fixedly positioned inside said capsule;

a movable armature comprised of a beam of magnetic material extending axially inside said helicoidal spring and being suspended to the ends of said helicoidal spring at two points symmetrically situated with respect to the transversal axis of said beam, the beam having a pair of pole ends which project beyond the helicoidal spring for alternately contacting a respective of said stationary contacts when the armature is pivoting; and a film of mercury wetting the surface of said armature, the helicoidal spring, the inner surface of said annular electrode and the surface of said stationary contacts.

2. A mercury reed switch according to claim 1, wherein the coacting surfaces of said polar ends of the armature and said stationary contacts are provided with spots made of a material which cannot be wetted with mercury.

3. A mercury reed switch according to claim 1 or 2, further comprising two metallic tubes positioned inside the capsule so as to surround said stationary contacts thereby to serve as magnetic shunts.

4. A mercury reed switch according to claim 1, wherein there is provided an annular permanent magnet coaxially extending around the capsule and centrally positioned relative to said annular electrode.

5. A mercury reed switch according to claim 1, wherein there are provided a pair of permanent magnets attached externally to the capsule, said magnets having opposed magnetic directions.

6. A mercury reed switch according to claim 1, wherein a portion of said armature is polarized in one direction and an adjacent portion is oppositely polarized.

7. A mercury reed switch according to claim 4, wherein said armature is made of a hard magnetic material.

8. A mercury reed switch device comprising a housing, at least one mercury reed switch according to claim 1; at least one energizing coil for said mercury reed switch; and terminal means for external connections, said terminal means being connected to said fixed contacts and said annular electrode said switch, said coil, and said terminal means being located in said housing.

* * * * *